United States Patent [19]

Beson

[11] 3,965,977

[45] June 29, 1976

[54] CONTROL LINE EXITING COUPLING

[75] Inventor: John Beson, Houston, Tex.

[73] Assignee: McEvoy Oilfield Equipment Co., Houston, Tex.

[22] Filed: Aug. 26, 1974

[21] Appl. No.: 500,750

Related U.S. Application Data

[63] Continuation of Ser. No. 352,677, April 19, 1973, abandoned, and a continuation-in-part of Ser. No. 218,916, Jan. 19, 1972, Pat. No. 3,739,846.

[52] U.S. Cl. ..... 166/88; 285/357

[51] Int. Cl.[2] ..... E21B 33/03

[58] Field of Search ..... 166/88, 89; 285/137 A, 285/137 R, 196, 356, 357; 277/116.2

[56] References Cited

UNITED STATES PATENTS

| | | | |
|---|---|---|---|
| 2,042,229 | 5/1936 | Jones | 285/356 |
| 2,488,470 | 11/1949 | Gerweck et al. | 166/88 |
| 2,689,611 | 9/1954 | Martinson | 166/88 |
| 3,043,371 | 7/1962 | Rector | 166/88 |
| 3,306,358 | 2/1967 | Williams | 166/89 |
| 3,324,951 | 6/1967 | Balmer et al. | 166/89 |
| 3,523,579 | 8/1970 | Nelson | 166/89 |
| 3,688,841 | 9/1972 | Baugh | 166/89 |

FOREIGN PATENTS OR APPLICATIONS

| | | | |
|---|---|---|---|
| 677,459 | 1/1964 | Canada | 166/89 |
| 776,490 | 1/1968 | Canada | 166/89 |

*Primary Examiner*—James A. Leppink
*Attorney, Agent, or Firm*—Murray Robinson; Ned L. Conley; David Alan Rose

[57] ABSTRACT

The coupling comprises a flexible conduit, a packoff assembly, and a gland nut for compressing the packoff assembly. The conduit passes through a passage in a first member and is secured to the outlet of a second member. The nut is threaded into the passage of the first member to compress the packoff for sealing securement of the conduit to the first member even though the axes of the passage and of the outlet are not coincident. A collar is disposed on the interior end of the conduit to prevent the conduit from blowing out of the passage if the conduit should break or disconnect from the second member.

9 Claims, 1 Drawing Figure

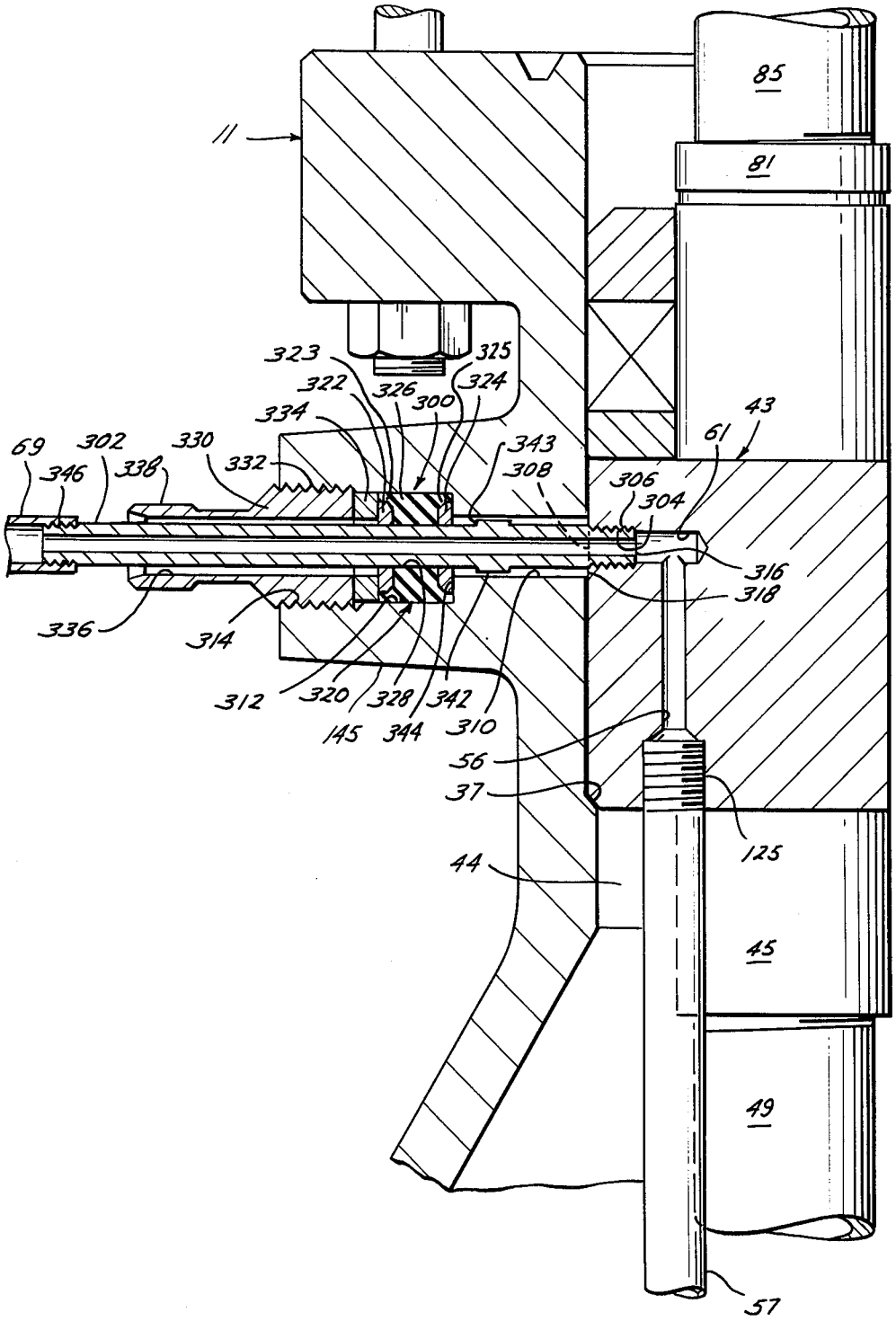
11
85
81
323
325
322
326
300
324
334
43
61
69
302
330
343
346
338
332
308
306
304
316
318
336
314
312
320
328
342
310
145
344
56
37
125
44
45
49
57

CONTROL LINE EXITING COUPLING

CROSS REFERENCES

This application is a continuation of Ser. No. 352,677, filed Apr. 19, 1973, now abandoned and a continuation-in-part of Ser. No. 218,916, filed Jan. 19, 1972 and now U.S. Pat. No. 3,739,846.

BACKGROUND OF THE INVENTION

1. Field of the Invention

This invention relates to couplings and more particularly to means for connecting a control line disposed interiorily of a wellhead element to a hydraulic line located exteriorly of the wellhead element.

2. Description of the Prior Art

In well completion equipment it is often found necessary to actuate a mechanism, such as a valve or the like, disposed within the well. The actuating means is generally powered by a hydraulic fluid in a pipe line or conduit extending down to the mechanism from the top of the well, e.g. from a source of pressurized hydraulic fluid on an above water platform in the case of a subsea well.

The hydraulic fluid conduit or control line that extends from the mechanism to the top of the well is usually a small diameter pipe, e.g. ½ to 1 inch in outer diameter, disposed outside of the tubing suspended within the well from a tubing hanger. The tubing hanger is supported by a wellhead element or tubing head. Such a hydraulic fluid conduit or control line is generally threaded into a socket in the lower end of a longitudinal passage extending up through the body of the tubing hanger. At a suitable level a transverse passage extending horizontally, e.g. radially from the longitudinal axis of the well, within the tubing hanger communicates with the longitudinal passage within the tubing hanger to provide a fluid passage from the radial periphery of the tubing hanger to the control line. A radially extending bore is provided through the wall of the tubing head for alignment with the horizontal passage of the tubing hanger continuing the fluid passage to the exterior periphery of the wellhead element for connection with the hydraulic fluid line coming from a source of fluid under pressure.

The nature of the environment and of the equipment creates an alignment problem between the tubing head bore and the tubing hanger passage. The equipment and apparatus is large and bulky and is difficult to rotate once installed. Further several thousand feet of tubing is suspended from the tubing hanger. These factors make it hard to align the tubing hanger with respect to the tubing head. It is also difficult to manufacture such apparatus whereby even if the hanger and head were properly oriented that the bore and passage would be coaxial.

In the above described construction there exists the further objection that upon the attempted installation of prior art couplings leakage will occur at the connection between the hydraulic line and the tubing hanger due to improper alignment. Improper alignment further increases the possibility of leakage of well fluids between the coupling and the tubing head.

Another objection to the earlier couplings is the use of a slip fit connection between the coupling and the tubing hanger since such a connection requires a resilient seal. A resilient seal is not desirable due to the shortness of the life of the seal and to the lack of strength and corrosive resistance of the seal as compared to a metal-to-metal seal.

SUMMARY OF THE INVENTION

According to the invention the aforementioned objections are overcome by providing a coupling which does not require the coaxial alignment of the tubing head bore, tubing hanger passage, and the connecting coupling. A flexible conduit is passed through the tubing head bore and is threaded into the tubing hanger passage. A sufficient distance is provided between the threaded engagement of the tubing hanger and the conduit and the sealing engagement of the tubing head and the conduit that the conduit is permitted to bend so as to thread into the hanger and also to be centered for sealing engagement with the tubing head.

Further, the conduit is sealingly secured to the tubing head bore by means of a compressible seal. The use of the compressible seal permits the conduit to be off-center within the tubing head bore and still provide a sealing connection.

Another advantage of the present coupling is the use of a metal-to-metal seal between the coupling and the tubing hanger.

A further advantage is a collar around the conduit to prevent the conduit from blowing out of the tubing head bore.

Other objects and advantages of the invention will appear from the following description of the preferred embodiments thereof.

BRIEF DESCRIPTION OF THE DRAWINGS

For a detailed description of the preferred embodiment of the invention, reference will now be made to the accompanying drawing wherein a vertical section is shown through an embodiment of the invention.

DESCRIPTION OF THE PREFERRED EMBODIMENT

The environment of the present invention is illustrated generally in FIGS. 1 and 2 of Patent Application Ser. No. 218,916 filed Jan. 19, 1972, of which this application is a continuation-in-part.

Referring now to the Drawing there is shown a wellhead structure including a tubing head 11 which is secured and sealed to a casing head (not shown). The casing head may surmount further casing heads with the stack of casing heads being connected together in any known manner as desired. Surmounting the wellhead structure is a tree (not shown).

In the upper part of the tubing head 11 shown in the drawing, there is an annular shoulder 37 on which is supported the tubing hanger 43. A tubing string 49 is supported from the hanger 43 by virtue of the upper end of the string being screwed into a support coupling 45.

The tubing hanger 43 is supported within tubing head 11 in a predetermined azimuthal position by lock screws (not shown). These lock screws also retain the hanger 43 on shoulder 37 and may support some of the weight and pressure on the hanger 43. The hanger 43 has at least one flow passage (not shown) therethrough. Support coupling 45 is connected at the lower end of the hanger 43 in fluid flow relationship with the flow passage. The annulus 44 created between the hanger 43 and the tubing head 11 may contain well fluids under pressure thereby requiring that all apertures in the wellhead element be sealed.

There is a tubular seal coupling 81 integral with and extending upwardly from the hanger 43 in fluid flow relationship with the flow passage of hanger 43. A flow nipple 85 is screwed into coupling 81 in fluid tight relationship and extends upwardly for sealing securement within the tree.

When the well is flowing, oil or gas flows upwardly through tubing string 49 and into support coupling 45 and thence through the flow passage of hanger 43 and seal coupling 81 into flow nipple 85 and into the tree. It should be clear that the above described construction could be applicable to either a single or a multiple completion.

A pipe 57 for hydraulic pressure extends downwardly from the tubing hanger 43 to a mechanism (not shown) disposed within the well. Pipe 57 constitutes a hydraulic control line to actuate the mechanism. An example of such a mechanism is described in Application Ser. No. 218,916 as a ball valve disposed in the tubing string 49 to regulate the fluid flow through tubing string 49.

The line 57 extends from the mechanism to the hanger 43 where it is screwed into a socket 125 in the lower end of the body of tubing hanger 43. Socket 125 is at the lower end of vertical fluid passage 56 which extends upwardly in hanger 43 until passage 56 communicates with transverse fluid passage 61 extending radially to the peripheral side of hanger 43.

Transverse fluid passage 61 is aligned or registered with horizontal bore 310 passing from the internal periphery of tubing head 11 to the external periphery of head 11. Bore 310 is formed in boss 145 on the side of tubing head 11. Bore 310 further includes a counterbore 312 (to be discussed later) adjacent the external periphery of head 11 creating annular shoulder 344. Internal threads 314 are provided on a portion of counterbore 312.

A hydraulic control fluid passage means or control line exiting coupling 300 is mounted within bore 310 of head 11 to link transverse fluid passage 61 with hydraulic fluid line 69. Line 69 leads to a suitable source of pressurized hydraulic fluid (not shown) and to valve means for actuating the mechanism disposed within the well.

The coupling 300 includes flow means as for example conduit 302 for providing fluid tight communication between fluid passage 61 and hydraulic fluid line 69. Conduit 302 passes through bore 310 for sealing connection to fluid passaage 61 at its mouth or outlet 308. The sealing connection between conduit 302 and hanger 43 provides a metal-to-metal seal. One such connection means includes externally tapered pipe threads 304 on the interior end 316 of conduit 302 threadingly and sealingly engaging internally tapered pipe threads 306 in outlet 308 of passage 61.

Bore 310 has a diameter sufficiently large to permit the alignment and registry of outlet 308. The diameter of bore 310 may be dictated by the general margin of error generally encountered in such an operation. It is, of course, the purpose of the present invention to avoid the requirement that bore 310 and passage 61 have coincident longitudinal axes before passage 61 and line 69 can be properly linked in fluid tight relationship and before coupling 300 can be sealingly secured within tubing head bore 310.

Conduit 302 provides one means of avoiding the alignment problem. Conduit 302 is made of a ductile material such as steel. This ductile material is as flexible as possible and yet still have the strength and corrosive resistance to handle the internal pressures and corrosion caused by the hydraulic fluid. The greater the flexibility, the easier the linkage between passage 61 and line 69 through the bending of conduit 302 between outlet 318 and shoulder 344 to permit conduit 302 to have one portion coaxial with passage 61 and another portion coaxial with counterbore 312.

In the prior art couplings no clearance is provided between the interior of bore 310 and the periphery of conduit 302 to permit any bending of conduit 302 within bore 310. Further even if such a clearance existed, there was insufficient distance between the connection of the conduit 302 to tubing hanger 43 and the connection of the conduit 302 to tubing head 11. The present invention provides such clearances and distances to permit conduit 302 to flex between those connections. The clearance between bore 310 and conduit 302 and the distance between the hanger connection and the head connection are only limited by the size of boss 145.

A second means of resolving the alignment problem is the new securement means provided to sealingly secure conduit 302 within bore 310 even though conduit 302 is off-center and is not coaxial with counterbore 312. The securement means includes a packoff assembly 320 which has a common bore 328 of a diameter slightly larger than the outside diameter of conduit 302. Packoff 320 includes packing 326, such as a rubber ring, sandwiched between float rings 322, 324. Packoff 320 is inserted into counterbore 312 to circumscribe conduit 302. Rings 322, 324 have an outside diameter substantially less than the inside diameter of counterbore 312. This permits rings 322, 324 to fit snugly around conduit 302 and yet allow conduit 302 to be secured offcenter within bore 310 since rings 322, 324 will not prevent a misalignment of conduit 302 within bore 310 due to a premature engagement of the periphery of rings 322, 324 and the interior of counterbore 312. The securement means does not fix conduit 302 within counterbore 312 but permits conduit 302 to float or slip within the securement means upon the application of sufficient force. However, the securement means does provide a frictional engagement between conduit 302 and packing 326.

A compression means, as for example a gland nut 330 having external threads 332 for threaded engagement with threads 314 of counterbore 312, is provided to compress packoff 320 to sealingly secure conduit 302 within bore 310. Nut 330 has a central core 336 for passage of nut 330 around conduit 302. Nut 330 further includes a plurality of wrench surfaces 338 on the end opposite threads 332 for the rotation of nut 330.

Since rings 322, 324 have an outer diameter substantially less than the inner diameter of counterbore 312 permitting the misalignment of conduit 302 within bore 310, upon compression of packing 326 between rings 322, 324, packing 326 is extruded over the top of rings 322, 324. Means for containing packing 326, as it extrudes over rings 322, 324, is required to maintain a sealing force normal to the inner surface of counterbore 312. As packing 326 is compressed it will extrude in every unbounded direction, and if it is permitted to extrude horizontally without containment, there will be no radial sealing force to achieve a satisfactory sealing engagement with the inner surface of counterbore 312. Therefore the annular spaces at 323 and 325 are necessarily made small so that packing 326 can extrude into those annular spaces and yet have sufficient compression remaining to further compress packing 326 radially to provide an adequate sealing engagement with the inner surface of counterbore 312. Since rings 322, 324 have an outer diameter substantially less than the inner diameter of counterbore 312, rings 322, 324 have a small thickness as compared to the thickness of packing 326 to reduce the volume of annular spaces at 323 and 325 and to achieve the desired objective. Shoulder 344 contains the extrusion of packing 326 over ring 324. However, to contain packing 326 over ring 322, it is necessary to plug the annular space around the periphery of ring 322. This may be done by projecting the inner end of gland nut 330 beyond the terminus of threads 314 or by providing a special plug such as bearing ring 334. In either case the outer periphery of the projection or ring slidingly engages the inner surface of counterbore 312.

On the preferred embodiment bearing ring 334 is inserted over conduit 302 and into counterbore 312 prior to the engagement of gland nut 330 primarily as a means to contain packing 326 but also as a means to reduce the friction between nut 330 and ring 322. As nut 330 is rotated to threadingly engage tubing head threads 314, bearing ring 334 bears against float ring 322 and shoulder 344 receives the thrust from float ring 324. Packoff 320 therefore contracts causing packing 326 to expand into sealing engagement between the interior of counterbore 312 and the external surface of conduit 302 thereby sealingly securing conduit 302 to tubing head 11. The distance between shoulder 344 and inlet 318 in bore 310 and the clearance between the interior of bore 310 and the periphery of conduit 302 provide space for conduit 302 to bend and flex within bore 310.

It is preferred that flexible conduit 302 and the securement means be used together rather than independently of each other, but it should be understood that the use of one does not require the use of the other. If they are used together, a successful connection will be obtained under a maximum of adverse conditions than if used separately. Together the securement means will provide a means for centering flexible conduit 302 within counterbore 312. Also using them together will not require conduit 302 to be coaxial with counterbore 312 thereby requiring an excessive bending of conduit 302 at shoulder 344 to obtain a good seal.

A collar 342 may be disposed on the external periphery of conduit 302 between shoulder 344 and inlet 318. Collar 342 has an outer diameter slightly larger than the inner diameter of float ring 324. A shoulder 343 is created between collar 342 and conduit 302 which will engage float ring 324 if conduit 302 slips radially within packoff 320. Collar 342 provides a means for removing packoff 320 upon disassembly of coupling 300. Further collar 342 is a safety feature by providing means for preventing conduit 302 from blowing out of bore 310 under pressure if the connection at outlet 308 breaks or if conduit 302 breaks between the collar 342 and inlet 318. This portion of the conduit is a critical portion since much stress and strain will be placed on it during assembly.

In the use of the above described apparatus, the tubing hanger 43 is landed in the tubing head 11. Hanger 43 is azimuthally aligned within tubing head 11 by lock screws. With hanger 43 in place and held down with lock screws, conduit 302 is inserted into bore 310 and threadingly engaged and sealed to outlet 308 of passage 61. The packoff 320 and bearing ring 334 are inserted into counterbore 312 and nut 330 compresses gland 320 for sealing securement between head 11 and conduit 302. Hydraulic line 69 is attached to conduit 302 such as by threads 346. The mechanism within the well may then be operated hydraulically.

While a preferred embodiment of the invention has been shown and described, modifications thereof can be made by one skilled in the art without departing from the spirit of the invention.

Further, while the preferred embodiment has been described in the environment of well completion apparatus, it should be realized that the present invention could be utilized as a coupling for plumbing fixtures, hose connections, electrical conduit and cable connectors, and other types of conduit connections.

I claim:

1. Means for providing flow communication through a first member with a contiguous second member having a passage therethrough comprising:

an enlarged bore through said first member;

a flexible tubular connector for insertion into the bore of the first member, said connector having an outside diameter substantially less than said enlarged bore;

said connector positionable within the first member in a plurality of angular positions;

connection means for connecting said connector to the second member adjacent the passage; and securement means sealing said connector within the bore of the first member; said securement means being located at a distance from said connection means to permit said connector to flex within the bore between the securement means and the connection means.

2. In means for making a connection through a tubing head to a threaded control line passage in a tubing hanger carried in the tubing head, the improvement which comprises a radial passageway through the wall of said tubing head, said passageway being substantially larger in section than said threaded passage so that the control line passage is within the bounds of the passageway even if the tubing hanger and tubing head are not aligned, a tubular conduit threadedly received within said threaded control line passage, said conduit having a diameter substantially smaller than the diameter of said passageway, whereby an annular opening is provided therein, a packing compression shoulder in said passageway, an annular nut threadedly received in said passageway radially outwardly from said tubing hanger and spaced away from said shoulder, and annular packing between said nut and said shoulder, said packing being compressible enough to seal against both said conduit and said passageway even when they are axially misaligned.

3. The means as defined in claim 2 further comprising means on said conduit other than threads in said passage for retaining said conduit in the passageway under pressure.

4. Means for providing a flow communication through a passage in a first member to a passage in a second member which passages are adjacent but may be misaligned; a conduit adapted for insertion into the passage of the first member; attachment means for attaching said conduit in flow communication with the second member adjacent the passage of the second member; and including seal means for sealing said conduit within the first member when said conduit and the passage of the first member are not coaxial comprising; annular ring members adapted for circumscribing said conduit and having an outer diameter substantially less than the inner diameter of the passage of the first member, packing disposed between said annular ring members;

means for compressing said packing between said annular ring members causing said packing to extrude over the periphery of said annular ring members; and means for containing the extrusion of said packing to provide adequate sealing engagement between said packing, said conduit, and the first member.

5. The means as defined in claim 4, said seal means being located at a distance from said attachment means to permit said conduit to flex between said attachment means and said securement means.

6. The means as defined in claim 4 further comprising packing on said conduit facilitating the removal of said securement means from the passage of the first member.

7. The means as defined in claim 4 wherein the compressing means includes means for reducing friction between said packing and said compressing means.

8. A first member having a cylindrical bore and radially extending passageway through its wall intersecting said bore;

a second member received within said bore of the first member having a cylindrical surface coaxial with said bore; said cylindrical surface of said second member having a radius substantially equal to the radius of said bore; said second member having a radial passageway intersecting said surface;

a tubular conduit sealingly engaging the passageway of said second member and extending radially therefrom through the passageway of the first member;

the passageway of the first member having a diameter substantially larger than the diameter of said conduit and the wall of the passageway of the first member;

and packing means around said conduit sealing between the conduit and said passageway of the first member.

9. Apparatus as defined by claim 8 and including:

a packing nut in the radially outward end of the passageway of the first member compressibly engaging said packing means, a washer around said conduit having an outside diameter less than the diameter of the passageway of the first member but greater than that of the bore of the nut, and a shoulder on said conduit intermediate said washer and the bore of the first member, said shoulder having a diameter greater than the inside diameter of said washer.

* * * * *

UNITED STATES PATENT AND TRADEMARK OFFICE

CERTIFICATE OF CORRECTION

PATENT NO. : 3,965,977

DATED : JUNE 29, 1976

INVENTOR(S) : JOHN BESON

It is certified that error appears in the above-identified patent and that said Letters Patent are hereby corrected as shown below:

This application is a division of Ser. No. 352,677, filed Apr. 19, 1973, now abandoned, which is a continuation-in-part of Ser. No. 218,916, filed Jan. 19, 1972 and now U. S. Patent No. 3,739,846.

Column 3, line 48: After "fluid", delete "passaage" and insert -- passage --.

Claim 5

Column 7, line 20: After "said", delete "securement" and insert -- seal --; so that the entire claim reads as follows:

5. The means as defined in claim 4, said seal means being located at a distance from said attachment means to permit said conduit to flex between said attachment means and said seal means.

UNITED STATES PATENT AND TRADEMARK OFFICE

CERTIFICATE OF CORRECTION

PATENT NO. : 3,965,977

DATED : JUNE 29, 1976

INVENTOR(S) : JOHN BESON

It is certified that error appears in the above-identified patent and that said Letters Patent are hereby corrected as shown below:

Claim 6

Column 7, line 22: After "ing", delete "packing" and insert -- a collar --; and column 7, line 23: After "said" delete "securement means" and insert -- packing --; so that the entire claim reads as follows:

6. The means as defined in claim 4 further comprising a collar on said conduit facilitating the removal of said packing from the passage of the first member.

Claim 7

Column 7, line 28: After the first occurrence of "said", insert -- annular rings and --; so that the entire claim reads as follows:

UNITED STATES PATENT AND TRADEMARK OFFICE

CERTIFICATE OF CORRECTION

PATENT NO. : 3,965,977

DATED : JUNE 29, 1976

INVENTOR(S) : JOHN BESON

It is certified that error appears in the above-identified patent and that said Letters Patent are hereby corrected as shown below:

7. The means as defined in claim 4 wherein the compressing means includes means for reducing friction between said annular rings and packing and said compressing means.

Claim 8

Column 7, between lines 28 and 29: Insert as a separate and complete line --8. In combination: --; and column 7, line 29: At the beginning of the line, delete "8.A" and insert -- a --; and column 8, line 13: After the first occurrence of "the", delete "wall" and insert -- diameter --; and column 8, line 13: After the third occurrence of "the", delete "first" and insert -- second --; so that the entire claim reads as follows:

UNITED STATES PATENT OFFICE

CERTIFICATE OF CORRECTION

Patent No. 3,965,977 Dated June 29, 1976

Inventor(s) John Beson Page 4 of 5

It is certified that error appears in the above-identified patent and that said Letters Patent are hereby corrected as shown below:

8. In combination:

a first member having a cylindrical bore and radially extending passageway through its wall intersecting said bore;

a second member received within said bore of the first member having a cylindrical surface coaxial with said bore; said cylindrical surface of said second member having a radius substantially equal to the radius of said bore; said second member having a radial passageway intersecting said surface;

a tubular conduit sealingly engaging the passageway of said second member and extending radially therefrom through the passageway of the first member;

UNITED STATES PATENT OFFICE

CERTIFICATE OF CORRECTION

Patent No. 3,965,977 Dated June 29, 1976

Inventor(s) John Beson

It is certified that error appears in the above-identified patent and that said Letters Patent are hereby corrected as shown below:

the passageway of the first member having a diameter substantially larger than the diameter of said conduit and the diameter wall of the passageway of the second member;

and packing means around said conduit sealing between the conduit and said passageway of the first member.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*